US010267063B2

(12) United States Patent
Lin et al.

(10) Patent No.: US 10,267,063 B2
(45) Date of Patent: Apr. 23, 2019

(54) ELECTRIC DOOR LOCK

(71) Applicant: I-TEK METAL MFG. CO., LTD, Tainan (TW)

(72) Inventors: Hsi-Ting Lin, Tainan (TW); Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 0 days.

(21) Appl. No.: 15/838,524

(22) Filed: Dec. 12, 2017

(65) Prior Publication Data

US 2018/0171672 A1 Jun. 21, 2018

Related U.S. Application Data

(63) Continuation-in-part of application No. 15/401,277, filed on Jan. 9, 2017.

(30) Foreign Application Priority Data

Dec. 19, 2016 (TW) ..... 105219263

(51) Int. Cl.
*E05B 47/02* (2006.01)
*E05B 9/08* (2006.01)
(Continued)

(52) U.S. Cl.
CPC ..... *E05B 47/02* (2013.01); *E05B 9/08* (2013.01); *E05B 47/00* (2013.01); *E05B 47/06* (2013.01); *E05B 47/0615* (2013.01); *E05B 47/0657* (2013.01); *E05B 55/005* (2013.01); *E05B 63/04* (2013.01); *E05B 17/002* (2013.01);
(Continued)

(58) Field of Classification Search
CPC ..... E05B 47/02; E05B 47/00; E05B 47/06; E05B 47/0657; E05B 9/08; E05B 63/04; E05B 55/005; E05B 47/0615; E05B 2047/0058; E05B 17/002; E05B 2047/0072; E05B 2047/0083; E05B 2047/0014; E05B 47/0001; E05B 63/0056; G07C 9/00563
USPC .. 70/277, 278.1, 278.2, 278.3, 278.7, 279.1, 70/280–283, 283.1; 292/144
See application file for complete search history.

(56) References Cited

U.S. PATENT DOCUMENTS 5,421,178 A * 6/1995 Hamel ..... E05B 47/0661 292/144
6,038,896 A * 3/2000 Chamberlain ..... E05B 47/0012 70/277
(Continued)

*Primary Examiner* — Lloyd A Gall
(74) *Attorney, Agent, or Firm* — Alan D. Kamrath; Kamrath IP Lawfirm, P.A.

(57) ABSTRACT

An electric door lock includes an operating device and a latch device operably connected to the operating device. An inner electronic device, an outer electronic device, and an electric driver are electrically connected by an electrical connecting module. An inner fixing member and an outer fixing member are fixed to a door. The inner fixing member includes an inner groove through which a first cable extends. The outer fixing member includes two first grooves. A second cable selectively extends through one of the two first grooves according to an assembling direction of the door. Thus, no matter whether the electric door lock is mounted to a left handed-door or a right-handed door, the electrical connecting module can avoid the mechanical structure of the electric door lock, providing convenient assembly.

9 Claims, 11 Drawing Sheets

(51) Int. Cl.

| | |
|---|---|
| ***E05B 47/06*** | (2006.01) |
| ***E05B 55/00*** | (2006.01) |
| ***E05B 63/04*** | (2006.01) |
| ***E05B 47/00*** | (2006.01) |
| *E05B 17/00* | (2006.01) |

(52) U.S. Cl.
CPC ... *E05B 47/0001* (2013.01); *E05B 2047/0014* (2013.01); *E05B 2047/0058* (2013.01); *E05B 2047/0072* (2013.01); *E05B 2047/0083* (2013.01)

(56) References Cited

U.S. PATENT DOCUMENTS 6,302,457 B1 * 10/2001 Shen ..... E05B 3/06 292/336.3
8,079,240 B2 * 12/2011 Brown ..... E05B 47/00 70/277
8,349,480 B1 * 1/2013 Chiang ..... G06F 1/1635 320/112
9,435,143 B2 9/2016 Shen
9,562,370 B2 * 2/2017 Ohl ..... E05B 47/068
2010/0031713 A1 * 2/2010 Brown ..... E05B 47/00 70/91
2012/0006082 A1 * 1/2012 Peng ..... E05B 47/068 70/277
2012/0055213 A1 * 3/2012 Sorensen ..... E05B 47/068 70/279.1
2014/0260451 A1 * 9/2014 Quach ..... E05B 47/0012 70/278.1
2015/0240530 A1 * 8/2015 Mani ..... E05B 63/04 292/336.3
2015/0300048 A1 * 10/2015 Yen ..... E05B 47/0012 292/144
2015/0315816 A1 * 11/2015 Gopalakrishnan ..... E05B 27/0003 70/344
2015/0315818 A1 * 11/2015 Shen ..... E05B 47/0012 292/144
2018/0171666 A1 * 6/2018 Tien ..... E05B 55/005

* cited by examiner

ELECTRIC DOOR LOCK

BACKGROUND OF THE INVENTION

The present invention relates to an electric door lock and, more particularly, to an electric door lock using an electronic signal to be identified for unlocking purposes and for controlling a locking or unlocking operation.

Door locks are anti-burglar devices mounted to doors for locking closed doors in place to prevent unauthorized opening. Conventional door locks are mechanical locks that can be locked or unlocked by keys. However, well-developed mechanical locks are apt to be tampered.

With the progress of technology, a type of electronic door lock includes a mechanical structure, an electric device (such as a motor or an electromagnetic valve), and electric equipment to proceed with control. Electronic unlocking information is inputted and identified to control an electromechanical structure to thereby move the mechanical structure for locking or unlocking purposes.

An electric door lock mounted on a door includes an outer portion and an inner portion. An input portion (such as a fingerprint input device, a pin number input device, etc.) of an electronic device is mounted to the outer portion. An identifying portion is mounted in the inner portion. An electric device for driving the mechanical structure can be mounted in an electromechanical portion. The identifying portion, the input portion, and the electric device must be electrically connected by wires to perform functions. The wires must avoid the mechanical structure and are arranged differently according to a right-handed door or a left-handed door. Thus, the wires of the electric door lock must be properly arranged and fixed while avoiding being pulled by the mechanical structure.

BRIEF SUMMARY OF THE INVENTION

An electric door lock according to the present invention includes an operating device configured to be set to a locking state or an unlocking state and adapted to be mounted to a door. A latch device is operably connected to the operating device. The latch device includes a latch. The operating device is configured to move the latch between a latching position and an unlatching position. An outer operating member is operably connected to the operating device. The outer operating member is configured to move the latch device from the latching position to the unlatching position. An electric driver is operably connected to the operating device. The electric driver is configured to set the operating device to the locking state or the unlocking state. An electrical connecting module is connected to the electric driver. The electrical connecting module includes a first cable and a second cable. The first cable and the second cable are outside of the operating device. An inner fixing member includes an inner mounting hole coupled with the operating device and an inner groove contiguous to the inner mounting hole. The first cable extends through the inner fixing member via the inner groove. The inner fixing member is adapted to be fixed on an inner surface of the door. An outer fixing member has an outer mounting hole coupled with the operating device and two first grooves contiguous to the outer mounting hole. The second cable extends through the outer fixing member via one of the two first grooves in an assembling direction along which the latch device and the operating device are installed on the door. The outer fixing member is adapted to be fixed on an outer surface of the door. An inner casing is coupled to the inner fixing member. The inner casing includes an inner room receiving the inner fixing member and an opening extending from an outer surface of the inner casing through an inner surface of the inner casing. An outer casing is coupled to the outer fixing member. The outer casing includes an inner side and an outer side. The outer casing further includes a first compartment formed at the inner side and receiving the outer fixing member and a second compartment formed at the outer side and spaced from the first compartment. The outer casing further includes a notch intercommunicating with the first compartment and the second compartment. An inner electronic device is received in the inner room of the inner casing. The inner electronic device is electrically connected to the first cable. The inner electronic device is configured to control the electric driver to set the operating device to the locking state or the unlocking state. An outer electronic device is fixed in the second compartment. The second cable is electrically connected to the outer electronic device through the notch. The outer electronic device is configured to send an unlocking signal to the inner electronic device. A power supply is coupled to the opening of the inner casing and is electrically connected to the inner electronic device.

In an example, an adjusting ring is threadedly engaged with the operating device and is received in the first compartment of the outer casing. The adjusting ring includes an outer periphery and two second grooves formed in the outer periphery. The two second grooves are respectively aligned with the two first grooves of the outer fixing member. The second cable extends through the adjusting ring via one of the two second grooves in the assembling direction.

In an example, two fixing pegs are fixed on the outer fixing member and are located outside of the outer mounting hole. The adjusting ring includes two positioning grooves formed in the outer periphery. Each of the positioning grooves is located between the two second grooves in a circumferential direction about a longitudinal axis defined by the operating device. The two fixing pegs are engaged with the two positioning grooves respectively. The two fixing pegs are configured to extend through the door. Two bolts extend through the inner fixing member and are threadedly engaged with the two fixing pegs respectively.

In an example, the two positioning grooves are spaced from each other by 180° in the circumferential direction about a longitudinal axis defined by the operating device.

In an example, the operating device includes a chamfered face formed on an outer surface of the operating device. The outer fixing member includes an abutting face formed at the outer mounting hole. The outer mounting hole of the outer fixing member is non-rotatably coupled with the operating device through the abutting face.

In an example, the first cable includes a first electric connector electrically connected to an end thereof. The second cable includes a second electric connector electrically connected to an end thereof. The inner electronic device includes a third electric connector detachably and electrically connected to the first electric connector. The outer electronic device includes a fourth electric connector detachably and electrically connected to the second electric connector. The notch is slightly larger than the fourth electric connector.

In an example, the outer electronic device includes a box having a space. A circuit board is received in the space. A cover is mounted to a side of the box and covers the space. The cover includes a pressing ring provided on an inner side of the cover. The pressing ring has annular cross sections. An elastic pad is mounted between the cover and the circuit board. The elastic pad includes a lip aligned with the pressing ring of the cover. The pressing ring of the cover presses against the lip of the elastic pad.

In an example, the outer electronic device further includes a plurality of buttons mounted between the cover and the circuit board. The elastic pad further includes a plurality of pressing portions. Each of the plurality of pressing portions supports a respective one of the plurality of the buttons, such that each of plurality of the buttons is biased to protrude outside of the cover.

The present invention will become clearer in light of the following detailed description of illustrative embodiments of this invention described in connection with the drawings.

Figure 1:
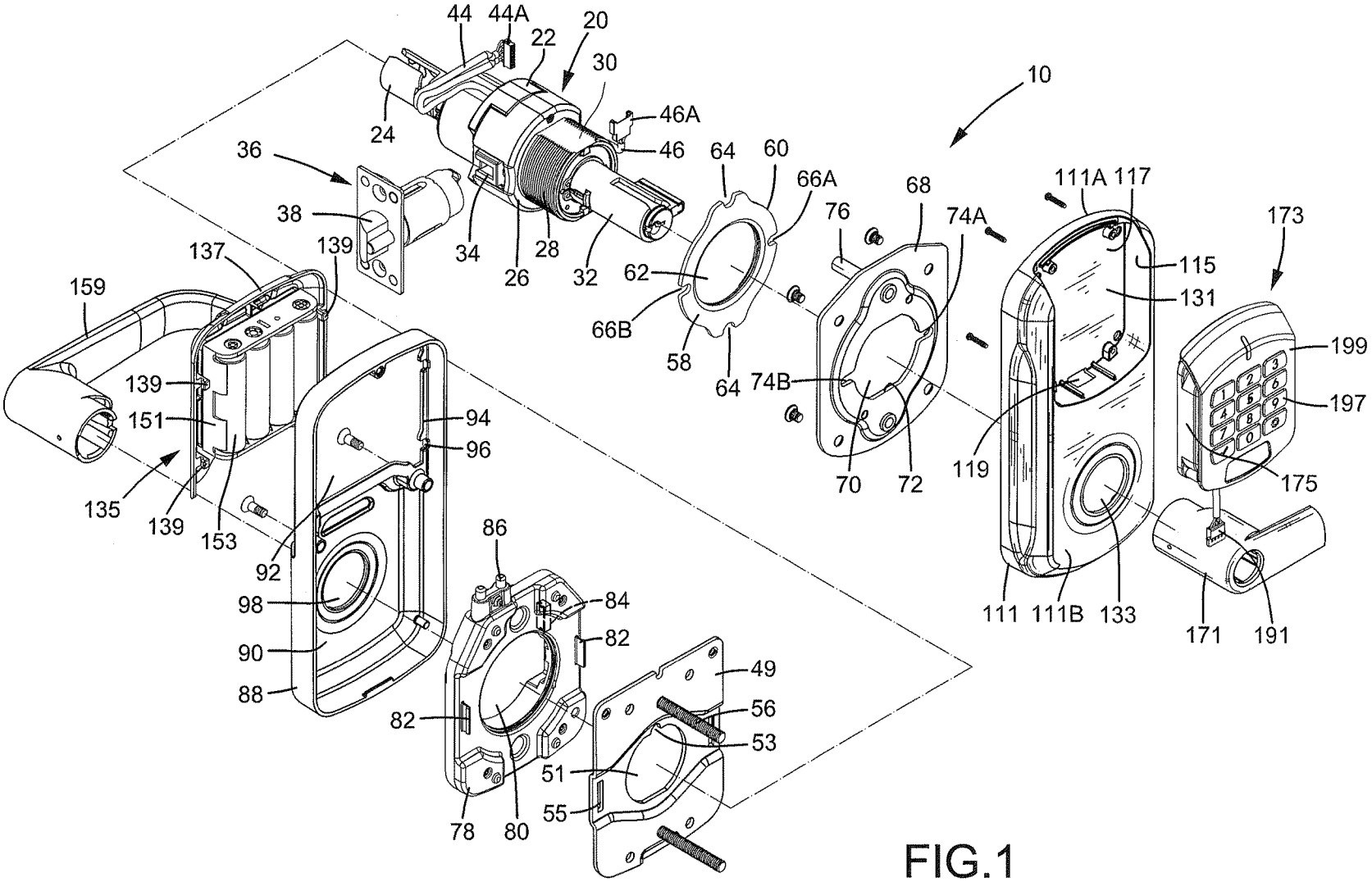
FIG. 1 is an exploded, perspective view of an electric door lock according to the present invention.
Figure 2:
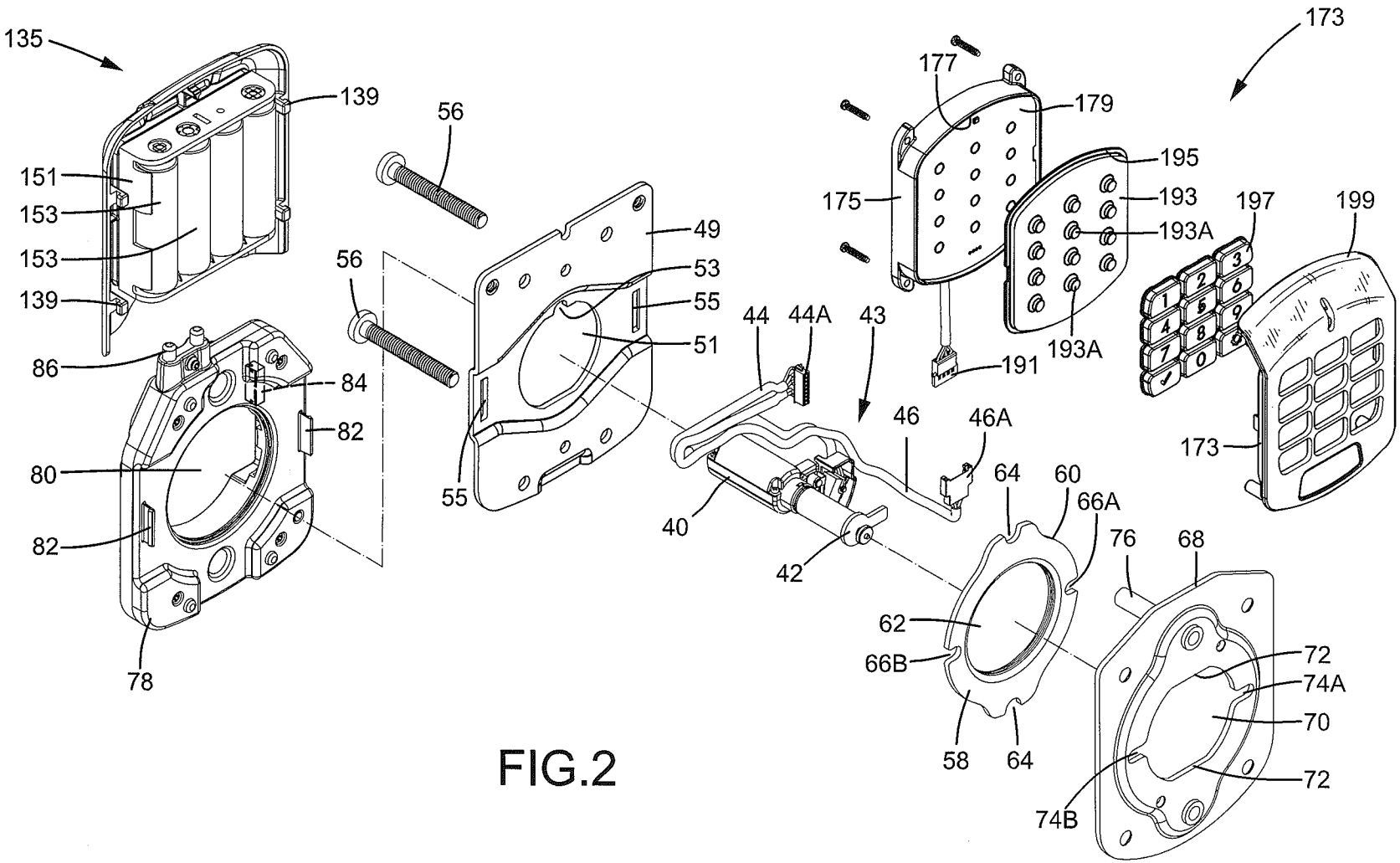
FIG. 2 is a partial, exploded, perspective view of the electric door lock of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "top", "bottom", "side", "end", "portion", "axial", "longitudinal", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

Figure 4:
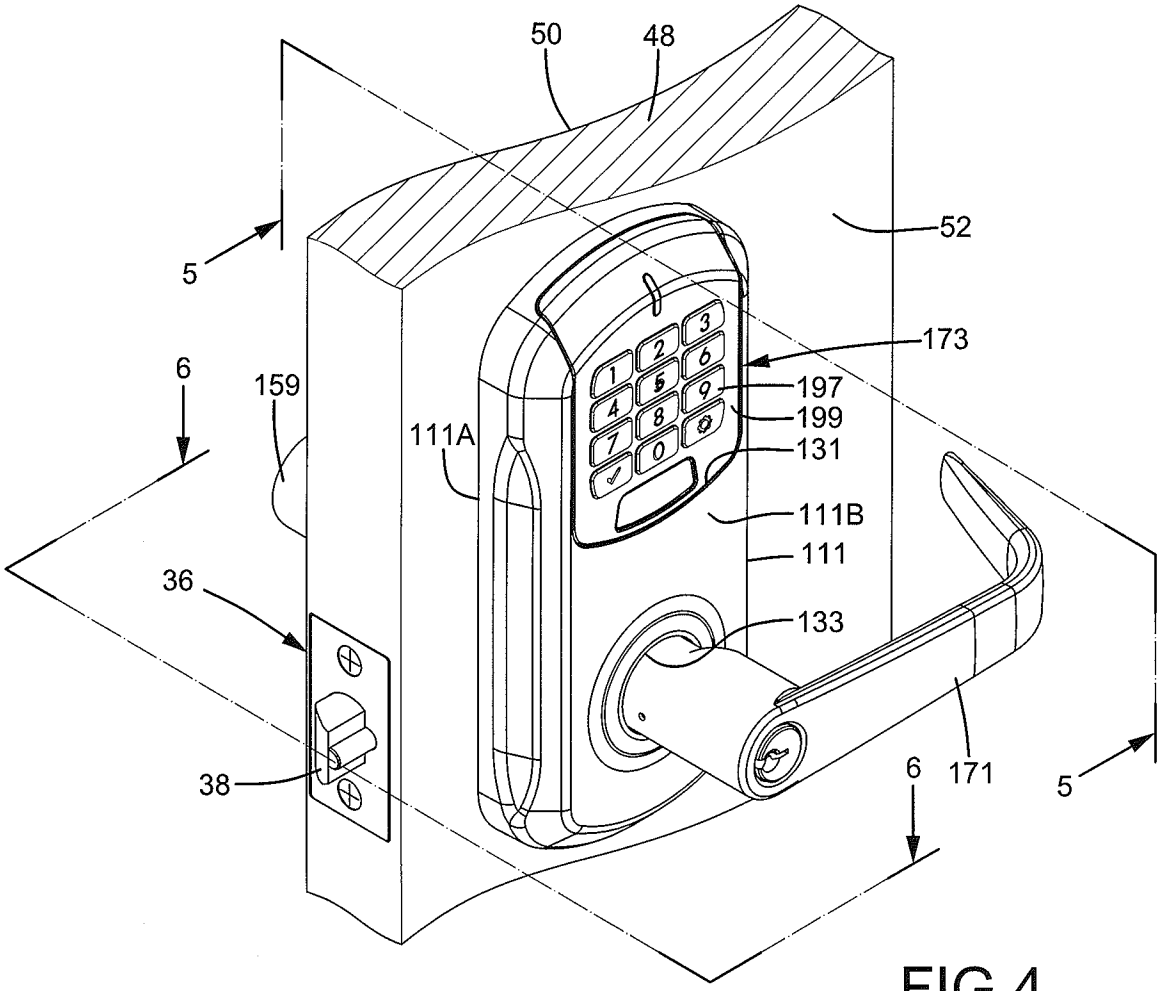
FIG. 4 is an assembled, perspective view of the electric door lock of FIG. 1 mounted on a door.
Figure 5:
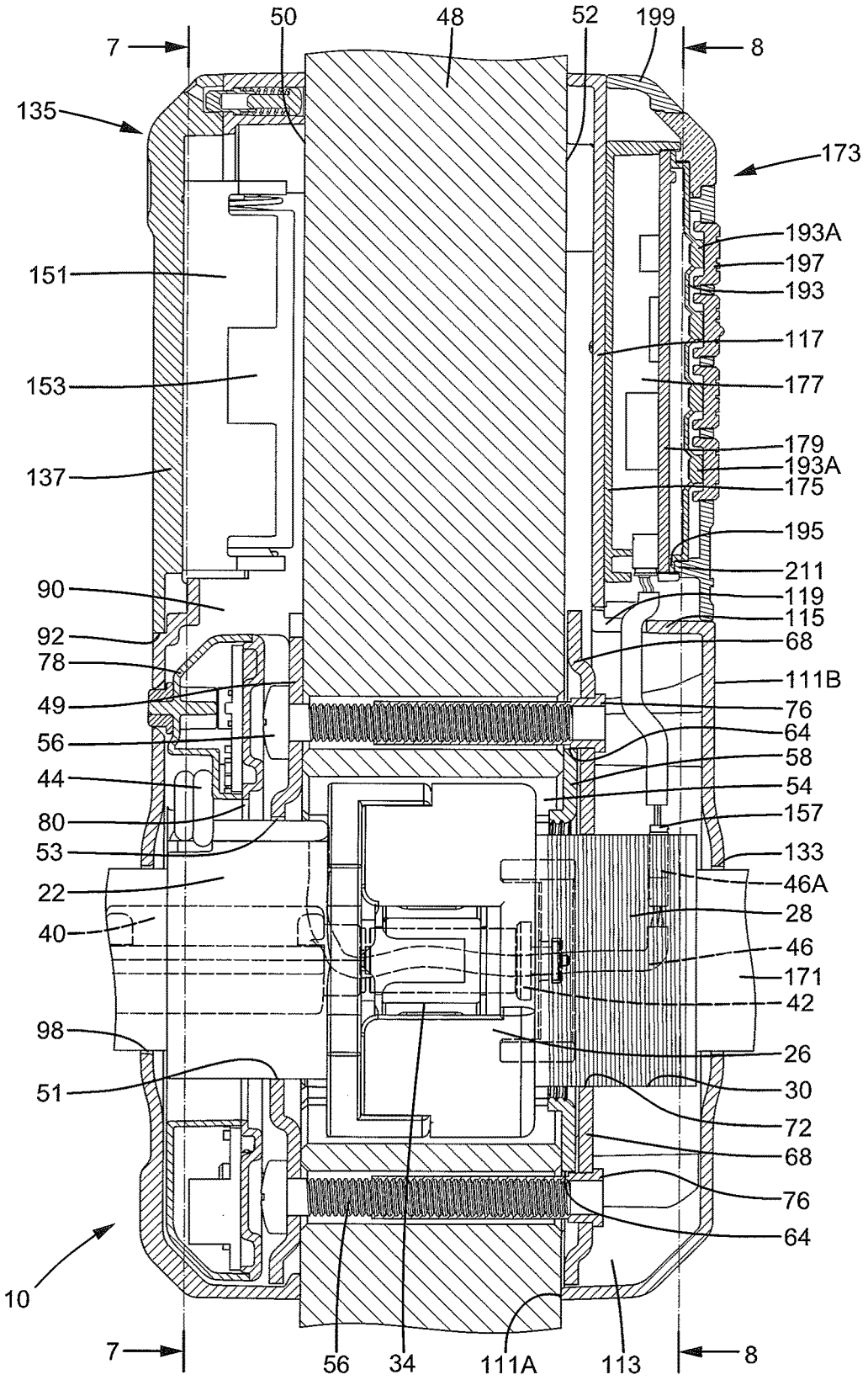
FIG. 5 is a cross sectional view taken along section line 5-5 of FIG. 4.

An electric door lock 10 according to the present invention is installed on a door 48. The door 48 includes an end face 48A, an inner surface 50, and an outer surface 52 spaced from the inner surface 50, with the inner surface 50 and the outer surface 52 connected to the end face 48A (FIGS. 4 and 5). The door 48 further includes a receiving hole 54 extending from the inner surface 50 to the outer surface 52.

The electric door lock 10 includes an operating device 20 mounted in the receiving hole 54 of the door 48. The operating device 20 includes an inner portion 22 and an outer portion 26 assembled with the inner portion 22 (FIG. 1). The operating device 20 further includes a retractor 34 movably installed between the inner portion 22 and the outer portion 26. The operating device 20 further includes an inner spindle 24 pivotably connected to the inner portion 22 and operably connected to the retractor 34 and an outer spindle 32 pivotably connected to the outer portion 26 and operably connected to the retractor 34. The outer portion 26 includes a threaded portion 28 having outer threads and two chamfered faces 30 formed on the threaded portion 28, with the two chamfered faces 30 being flat and symmetric to each other.

Figure 3:
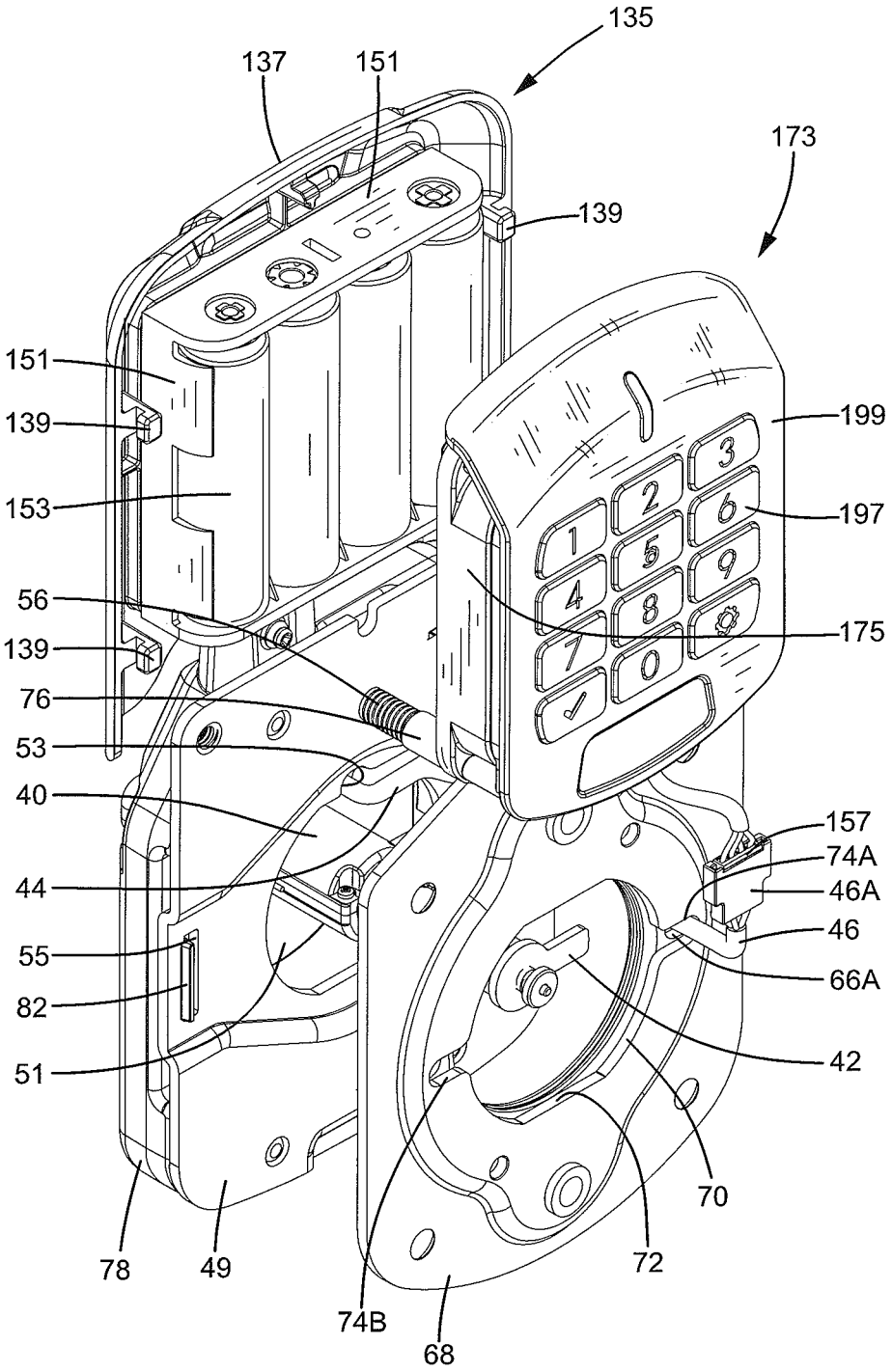
FIG. 3 is a perspective view of the electric door lock of FIG. 2 after assembly.

With reference to FIGS. 1, 3, and 5, the operating device 20 further includes an electric driver 40 mounted between the inner portion 22 and the outer portion 26. The electric driver 40 includes a limiting member 42 movably mounted in the outer portion 26. The electric driver 40 is connected to an electrical connecting module 43. The electrical connecting module 43 includes a first cable 44 and a second cable 46. The first cable 44 and the second cable 46 extend to an outer side of the operating device 20. The electrical connecting module 43 further includes a first electric connector 44A electrically connected to an end of the first cable 44 and a second electric connector 46A electrically connected to an end of the second cable 46. The operating device 20 is received in the receiving hole 54 of the door 48. The outer spindle 32 is located outside of the outer surface 52 of the door 48. The inner spindle 24 is located outside of the inner surface 50 of the door 48.

The electric door lock 10 further includes an inner fixing member 49 adapted to be fixed on the inner surface 50 of the door 48. The inner fixing member 49 includes an inner mounting hole 51 coupled with the operating device 20. The inner fixing member 49 further includes an inner groove 53 contiguous to the inner mounting hole 51 and two buckling portions 55 on two sides of the inner mounting hole 51. Each of the, two buckling portions 55 is spaced from each inner groove 53 by 90° in a circumferential direction about a longitudinal axis defined by the operating device 20.

The inner mounting hole 51 of the inner fixing member 49 is non-rotatably coupled with the inner portion 22 of the operating device 20. The first cable 44 extends through the inner fixing member 49 via the inner groove 53 such that the first electric connector 44A is also located out of the inner surface 50 of the door 48.

The electric door lock 10 further includes an outer fixing member 68 adapted to be fixed on an outer surface 52 of the door 48. The outer fixing member 68 includes an outer mounting hole 70 coupled with the operating device 20 and two first grooves 74A, 74B contiguous to the outer mounting hole 70. The outer fixing member 68 further includes two abutting faces 72 formed at the outer mounting hole 70 symmetric to each other corresponding to the two chamfered faces 30 of the outer portion 26. Each of the two abutting faces 72 is spaced from each of the two first grooves 74A and 74B by 90° in the circumferential direction about the longitudinal axis defined by the operating device 20 (FIG. 1). Two fixing pegs 76 are fixed on the outer fixing member 68. The two fixing pegs 76 are spaced from each other by 180° in the circumferential direction about the longitudinal axis defined by the operating device 20.

The outer fixing member 68 is received in a first compartment 113 of an outer casing 111. The two fixing pegs 76 are configured to extend through the door 48, such that the outer fixing member 68 cannot rotate relative to the door 48. The outer mounting hole 70 of the fixing member 68 is coupled with the threaded portion 28 of the outer portion 26. The two abutting faces 72 of the outer fixing member 68 abut with the two chamfered faces 30 respectively, such that the operating device 20 is limited by the outer fixing member 68 and cannot rotate relative to the door 48 about the longitudinal axis defined by the operating device 20. Furthermore, two bolts 56 extend through the inner fixing member 49 and are threadedly engaged with the two fixing pegs 76, such that the two bolts 56 are fastened. The inner fixing member 49 and the outer fixing member 68 securely clamp the inner surface 50 and the outer surface 52 of the door 48 respectively, thereby fixing the operating device 20.

The electric door lock 10 further includes an adjusting ring 58 threadedly engaged with the operating device 20. The adjusting ring 58 includes a screw hole 62 having inner threads and an outer periphery spaced from the screw hole 62. The adjusting ring 58 further includes two second grooves 66A and 66B spaced from each other and two positioning grooves 64 spaced from each other. Each of the two second grooves 66A and 66B is spaced from each of the two positioning grooves 64 by 90° in the circumferential direction about the longitudinal axis defined by the operating device 20.

The adjusting ring 58 is threadedly engaged with the threaded portion 28 of the operating device 20 and is received in the first compartment 113 of the outer casing 111. The adjusting ring 58 abuts a surface of the outer fixing member 68. Before the outer fixing member 68 is installed, the adjusting ring 58 can be rotated relative to the door 48 about the longitudinal axis defined by the operating device 20 to adjust the position of the operating device 20 along the longitudinal axis relative to the door 48. Thus, the retractor 34 can be adjusted to be in a central location in a thickness direction of the door 48. Furthermore, after the outer fixing member 68 is installed, the two fixing pegs 76 are engaged with the two positioning grooves 64 of the adjusting ring 58. Thus, the adjusting ring 58 cannot rotate relative to the operating device 20 and the outer fixing member 68, and the two second grooves 66A and 66B are aligned with the two first grooves 74A and 74B of the outer fixing member 68 respectively, thereby fixing the position of the operating device 20 along the longitudinal axis defined by the operating device 20.

With reference to FIGS. 3-6, the second cable 46 extends through the outer fixing member 68 and the adjusting ring 58 via the first groove 74A aligned with the second groove 66A or via the first groove 74B aligned with the second groove 66B in a direction along which the electric door lock 10 is installed on the door 48 (FIGS. 5-8), such that the second electric connector 46A is located in the first compartment 113 of the outer casing 111.

The electric door lock 10 further includes an inner electronic device 78 connected to the inner fixing member 49. The inner electronic device 78 includes two hooks 82 formed on a lateral side thereof and an electrode 86 on a top side thereof. The two hooks 82 are symmetrically disposed. The inner electronic device 78 further includes a third electric connector 84 fixed on a surface thereof and a through-hole 80 in a central portion.

Figure 7:
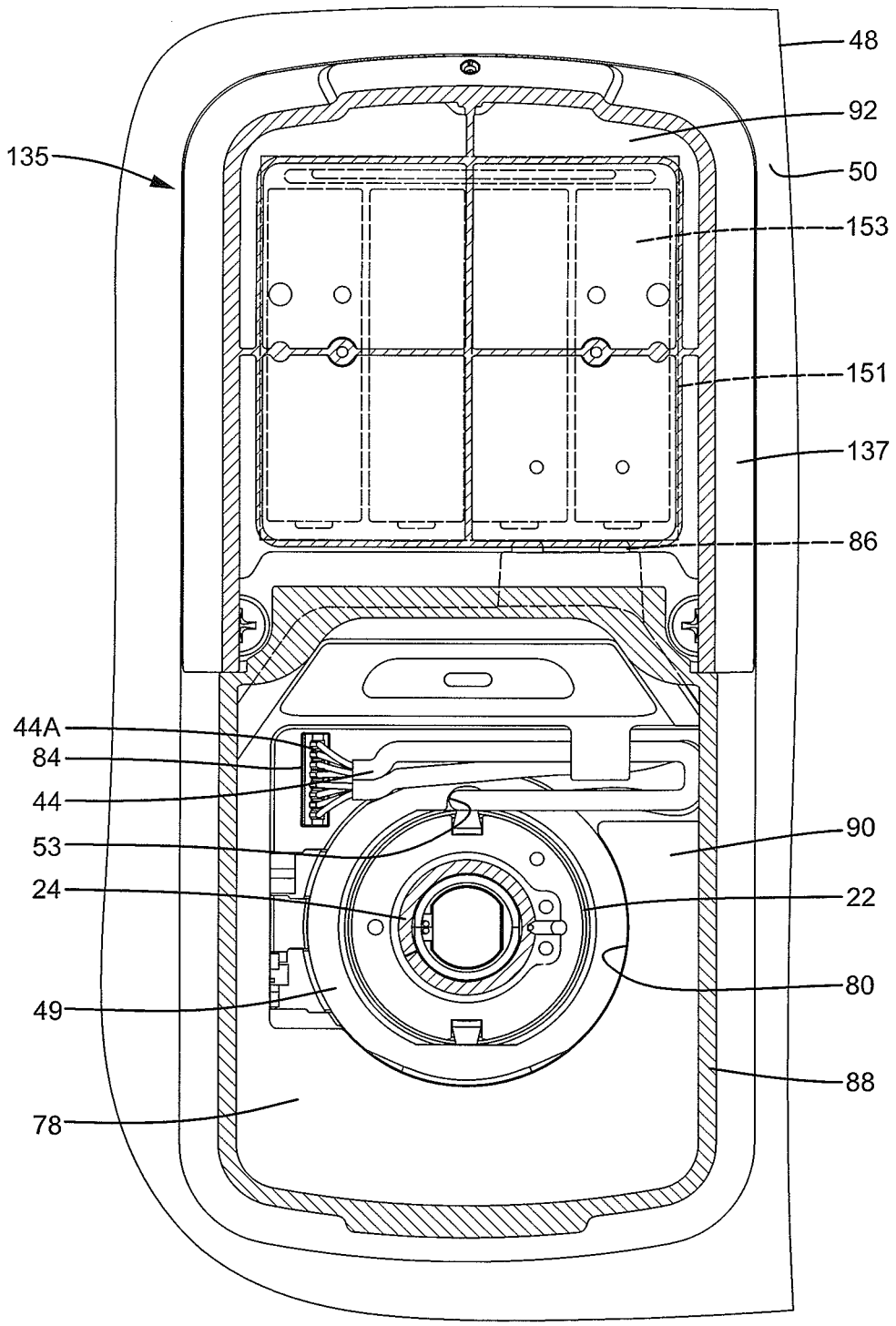
FIG. 7 is a cross sectional view taken along section line 7-7 of FIG. 5.
Figure 8:
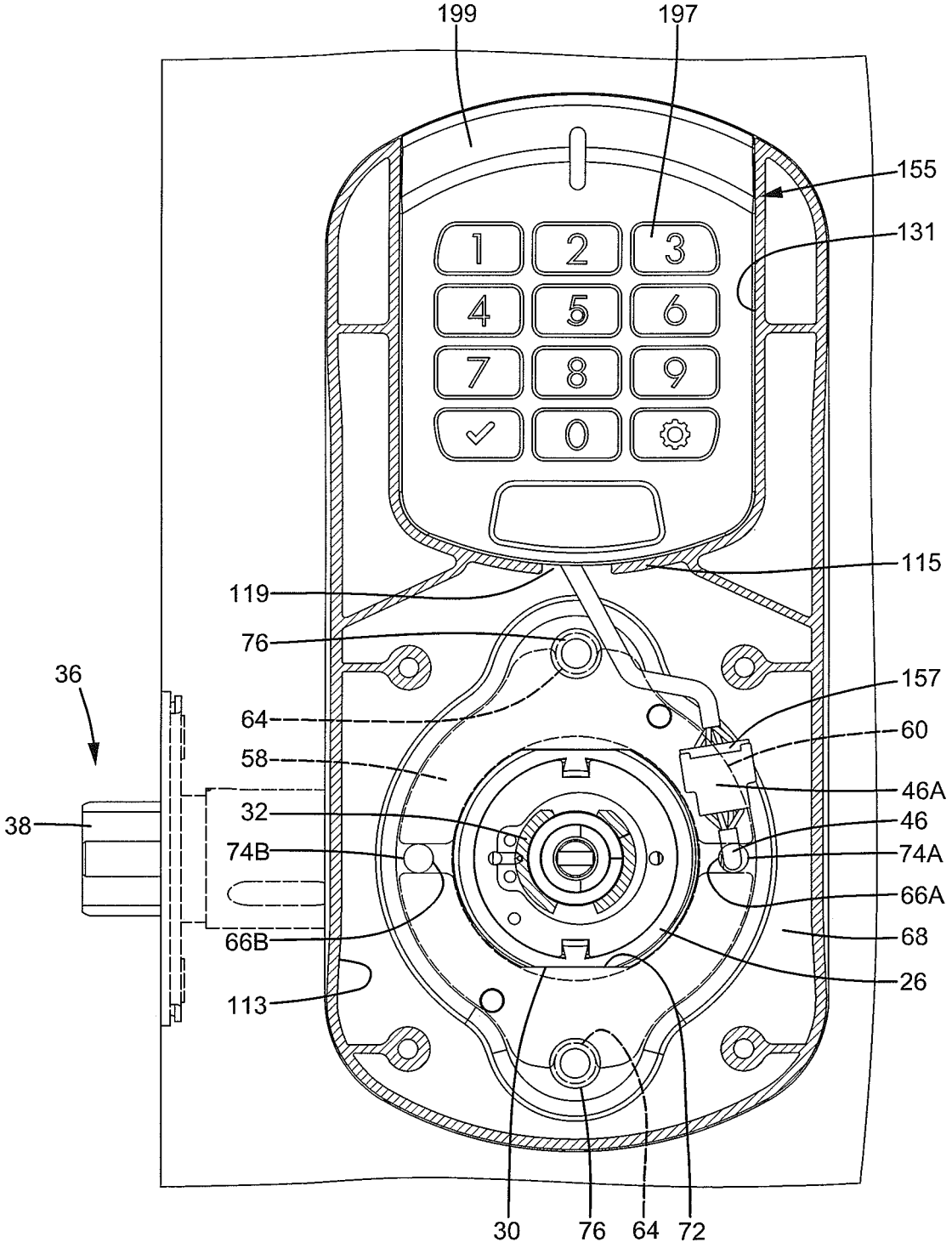
FIG. 8 is a cross sectional view taken along section line 8-8 of FIG. 5.
Figure 9:
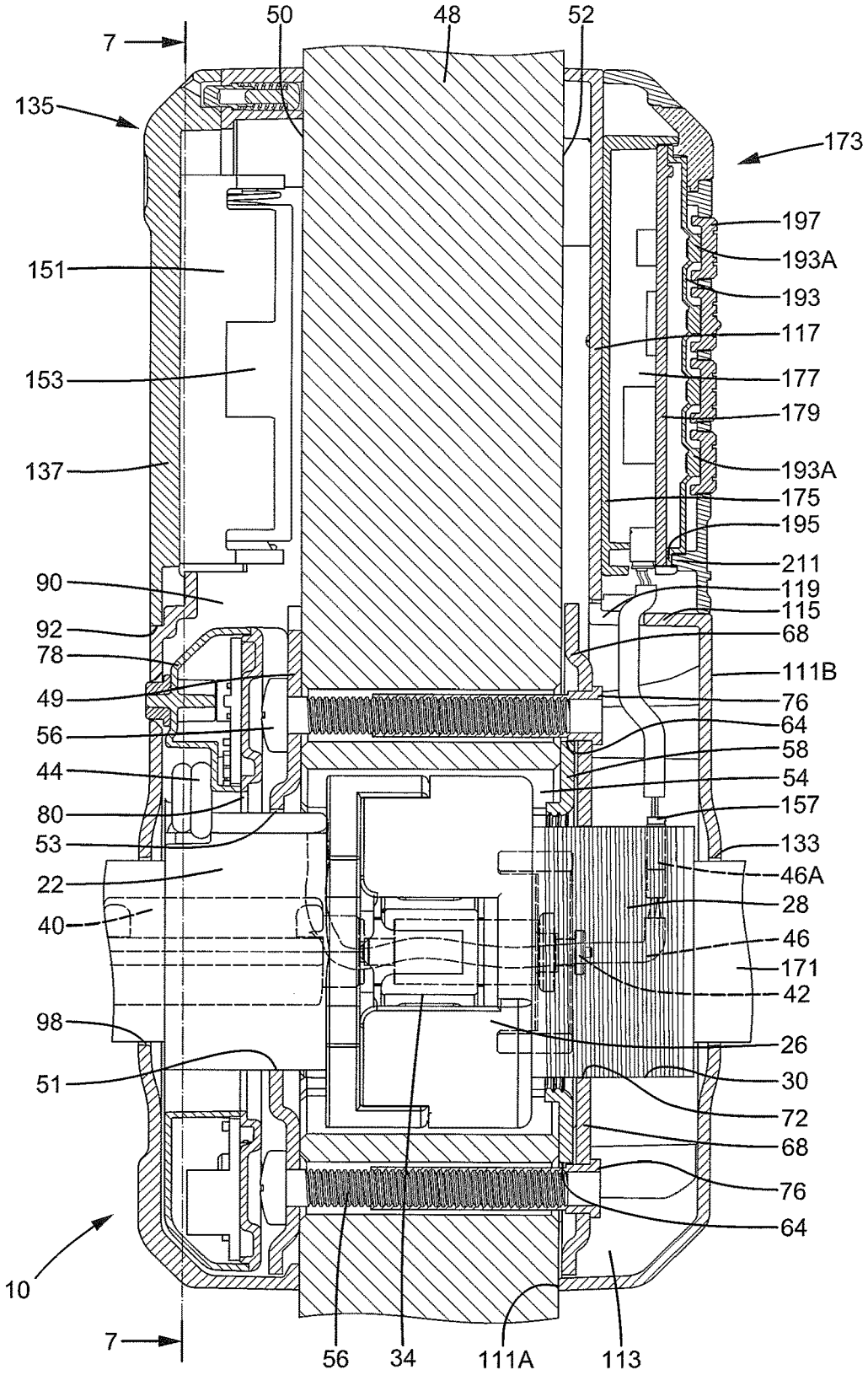
FIG. 9 is cross sectional view similar to FIG. 5, with a limiting member of an electric driver of the electric door lock moved to a second position.

The two hooks 80 of the inner electronic device 78 engage with the two buckling portion 55 of the inner fixing member 49 respectively, thereby coupling the inner electronic device 78 with the inner fixing member 49. The through-hole 80 is coupled with the inner portion 22. The first electric connector 44A is electrically connected to the third electric connector 84 (FIG. 7). The inner electronic device 78 is configured to control the electric driver 40 to move the limiting member 42 to a first position which allows the outer spindle 32 to pivot (FIG. 5) or a second position which does not allow the outer spindle 32 to pivot (FIG. 9).

The electric door lock 10 further includes an inner casing 88 connected to the inner fixing member 49. The inner casing 88 includes an inner room 90 and an opening 92 extending from an outer surface of the inner casing 88 to the inner room 90. Two coupling portions 94 in the form of ribs are formed at two sides of the opening 92. Each of the two coupling portions 94 includes two separating openings 96 spaced from each other. Furthermore, the inner casing 88 further includes a through-hole 98 extending from the outer surface thereof and to the inner room 90.

The inner casing 88 is threadedly engaged with the inner fixing member 49 through two screws. The inner electronic device 78 is received in the inner room 90 of the inner casing 88. A central axis of the through-hole 80 of the inner electronic device 78 is coincident to a central axis of the through-hole 98 of the inner casing 88. The electrode 86 of the inner electronic device 78 is located outside of the inner room 90. The inner casing 88 abuts the inner surface 50 of the door 48 (FIG. 5).

The electric door lock 10 further includes a power supply 135 detachably connected to the inner casing 88 and an inner operating member 159. The power supply 135 includes a lid 137 and a battery seat 151 fixed on the lid 137. The battery seat 151 is configured to install a plurality of batteries 153. The lid 137 includes four hooks 139 corresponding to the separating openings 96 of the inner casing 88.

Each of the four hooks 139 of the power supply 135 is detachably coupled with one of the coupling portions 94 of the inner casing 88. The electrode 86 of the inner electronic device 78 electrically abuts with the power supply 135, such that the inner electronic device 78 can operate by the electricity of the plurality of the batteries 153 of the power supply 135 (FIG. 7).

The inner operating member 159 extends through the through-hole 98 of the inner casing 88 and is coupled with the inner spindle 24 of the inner portion 22, such that the inner operating member 159 is configured to pivot the inner spindle 24 and to move the retractor 34. The inner operating member 159 can be a spherical or L-shaped handle.

The electric door lock 10 further includes an outer casing 111 and an outer operating member 171. The outer casing 111 includes an inner side 111A and an outer side 111B. The outer casing 111 further includes a first compartment 113 formed at the inner side 111A and a second compartment 131 formed at the outer side 111B and spaced from the first compartment 113. The second compartment 131 includes a peripheral wall 115 and a bottom wall 117. The outer casing 111 further includes a notch 119 formed in the peripheral wall 115 and intercommunicating with the first compartment 113 and the second compartment 131. The outer casing 111 further includes a through-hole 133 formed on the outer surface 111B and extending to the first compartment 113.

The outer casing 111 is threadedly engaged with the outer fixing member 68 through a plurality of screws. The outer fixing member 68 is received in the first compartment 113. The through-hole 133 has a central axis coincident to a central axis of the outer mounting hole 70. The inner side 111A of the outer casing 111 abuts the outer surface 52 of the door 48. The outer operating member 171 extends through the through-hole 133 of the outer casing 111 and is coupled with the outer spindle 32, such that the outer operating member 171 can rotate the outer spindle 32 to thereby move the retractor 34. The outer operating member 171 can be a spherical or L-shaped handle.

Figure 5A:
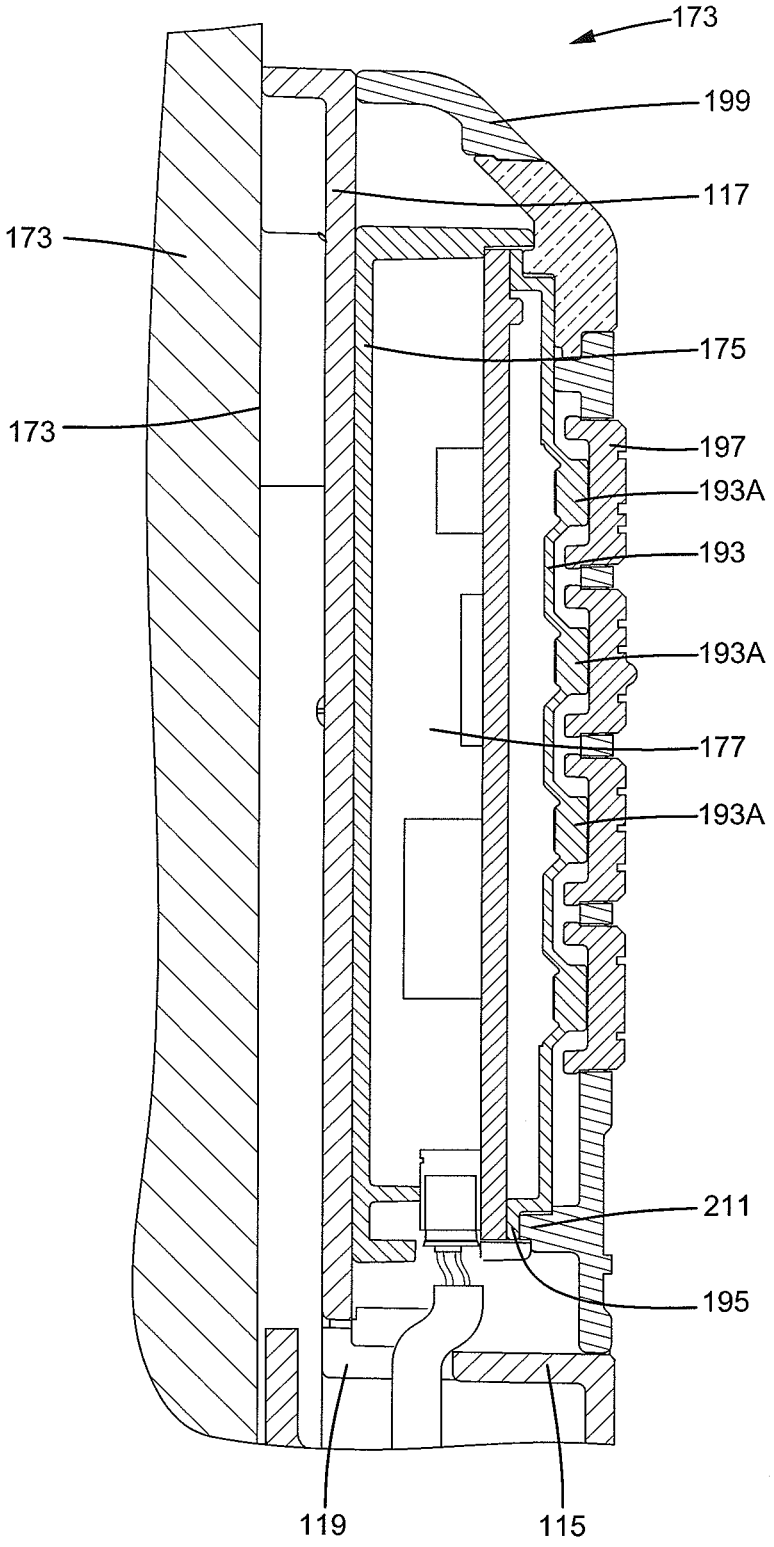
FIG. 5A is an enlarged view of a portion of the electric door lock of FIG. 5.

The electric door lock 10 further includes an outer electronic device 173 mounted on the outer casing 111. The outer electronic device 173 includes a box 175 having a space 177 configured to receive a circuit board 179. A cover 199 is mounted to a side of the box 175 and covers the space 177. The cover 199 has a pressing ring 211, such as an annular protrusion, protruding from an inner side of the cover 199 (see FIG. 5A). The pressing ring 211 includes cross sections identical to a contour of the circuit board 179. A plurality of buttons 197 is mounted between the cover 199 and the circuit board 179. A portion of each of the plurality of buttons 197 is exposed outside of the cover 199. An elastic pad 193 is mounted between the cover 199 and the circuit board 179. The elastic pad 193 includes a lip 195 extending along an outer periphery of the elastic pad 193 and aligned with the pressing ring 211 of the cover 199. The elastic pad 193 further includes a plurality of pressing portions 193A. A shape of the lip 195 is identical to the cross sections of the pressing ring 211. The pressing ring 211 of the cover 199 presses against a side of the lip 195 of the elastic pad 193. The other side of the lip 195 of the elastic pad 193 abuts with the circuit board 179, such that water and dust are prevented from entering circuit board 179 via the elastic pad 193. Each of the plurality of pressing portions 193A supports a respective one of the plurality of the buttons 197, such that each of plurality of the buttons 197 is biased to protrude outside of the cover 199. Furthermore, when one of the plurality of buttons 197 is pressed, the pressing portion 193A is elastically deformed, and a back side of the pressing portion 193A contacts with the circuit board 179, such that the circuit board 179 detects which one of the plurality of the buttons 197 is pressed to operate correspondingly.

The outer electronic device 173 further includes a fourth electric connector 191 electrically connected to the circuit board 179. The outer electronic device 173 is received in the second compartment 131 and is threadedly fixed by four screws. The notch 119 is slightly larger than the fourth electric connector 191, such that the fourth electric connector 191 extends through the notch 119 and enters in the first compartment 113 for detachably and electrically connecting with the second electric connector 46A (FIG. 5). Thus, the inner electronic device 78, the outer electronic device 173 and the electric driver 40 are electrically connected. The outer electronic device 173 is configured to send an unlocking signal to the inner electronic device 78 for identification. The outer electronic device 173 is a keypad-type pin number entering device (electronic type), such that user can use the digital numbers of the outer electronic device 173 to input a pin number to the inner electronic device 78 for identification purposes.

Figure 6:
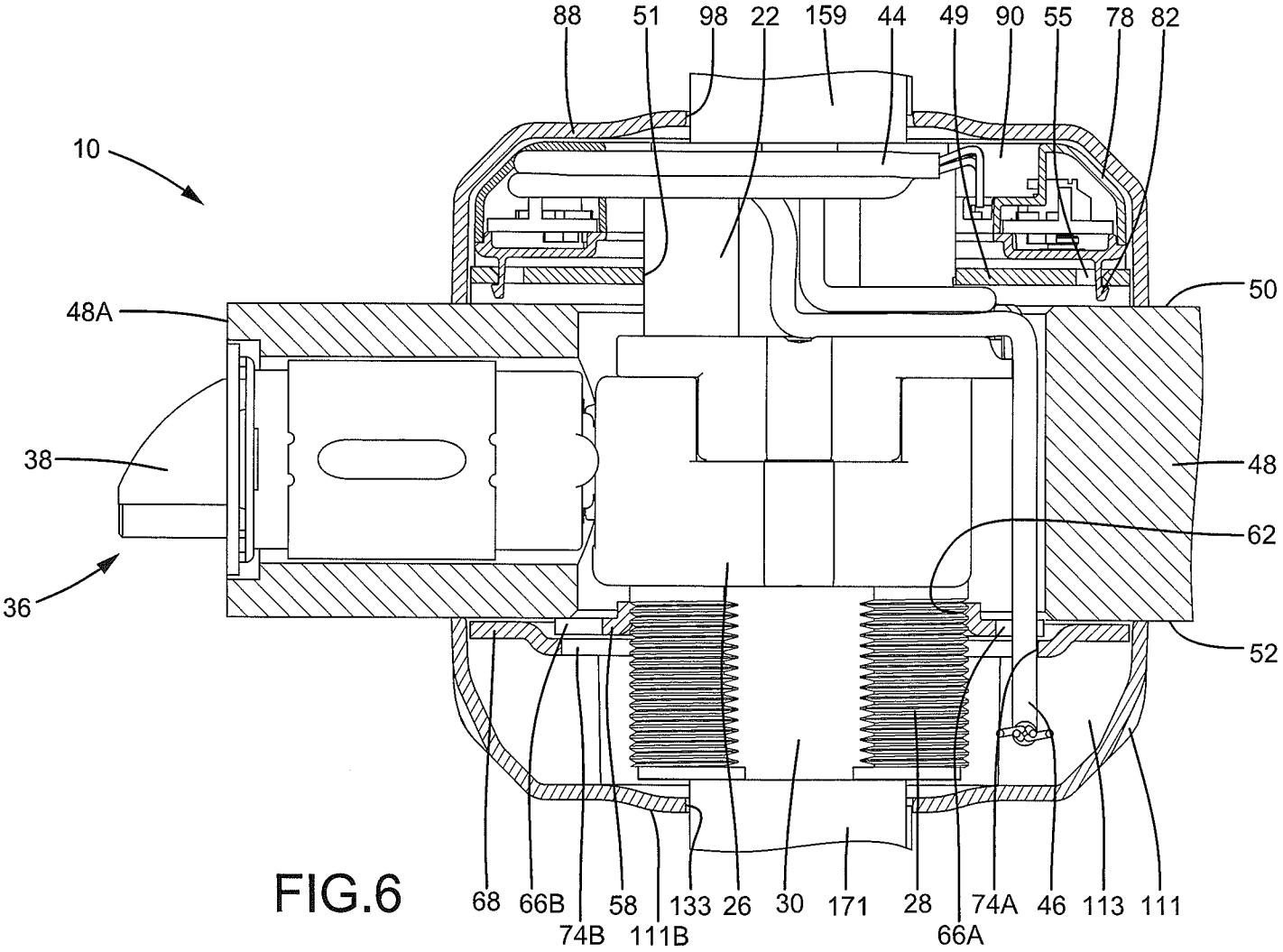
FIG. 6 is a cross sectional view taken along section line 6-6 of FIG. 4.

With reference to FIG. 6, the door lock 10 further includes a latch device 36 mounted on the end face 48A of the door 48. The latch device 36 includes a latch 38 configured to move between a latching position (extended position) and an unlatching position (retracted position). The latch device 36 is operably connected to the retractor 34, such that the retractor 34 moves the latch 38 from the latching position to the unlatching position when the inner operating member 159 or the outer operating member 171 is rotated.

With reference to FIGS. 4-6, and 8, the electric door lock 10 is installed on a left-handed door. The latch device 36 is located on the same side as the first groove 74B and the second groove 66B, such that the second cable 46 of the electrical connecting module 43 selectively extends through the outer fixing member 68 and the adjusting ring 58 via the first groove 74A and the second groove 66A respectively. This prevents the second cable 46 and the latch device 36 from interfering with each other.

With reference to FIG. 5, when a correct pin number is inputted via the outer electronic device 173 and when the inner electronic device 78 identifies that the pin number is correct, the inner electronic device 78 outputs an unlocking signal to the electric driver 40, such that the electric driver 40 operates to move the limiting member 42 to the first position. Thus, the operating device 20 is set to an unlocking state. Then, the outer operating member 171 can be pivoted to actuate the outer spindle 32 to thereby move the retractor 34, which, in turn, moves the latch 38 from the latching position (FIG. 6) to the unlatching position.

With reference to FIG. 9, when an incorrect pin number is inputted via the outer electronic device 173 and when the inner electronic device 78 identifies that the pin number is incorrect or no pin number is inputted, the inner electronic device 78 outputs a locking signal to the electric driver 40, such that the electric driver 40 operates to move the limiting member 42 to the second position. Thus, the operating device 20 is set to a locking state. In this case, the outer spindle 32 is fixed and not rotatable, such that the retractor 34 cannot be moved by rotating the outer operating member 171. Thus, the latch 38 of the latch device 36 remains in the latching position, and the door 48 is locked.

It is noted that no matter whether the limiting member 42 is in the first position or the second position, the inner operating member 159 can be operated to rotate the inner spindle 24 to thereby actuate the retractor 34, which, in turn, moves the latch 38 of the latch device 36 from the latching position to the unlatching position.

Figure 10:
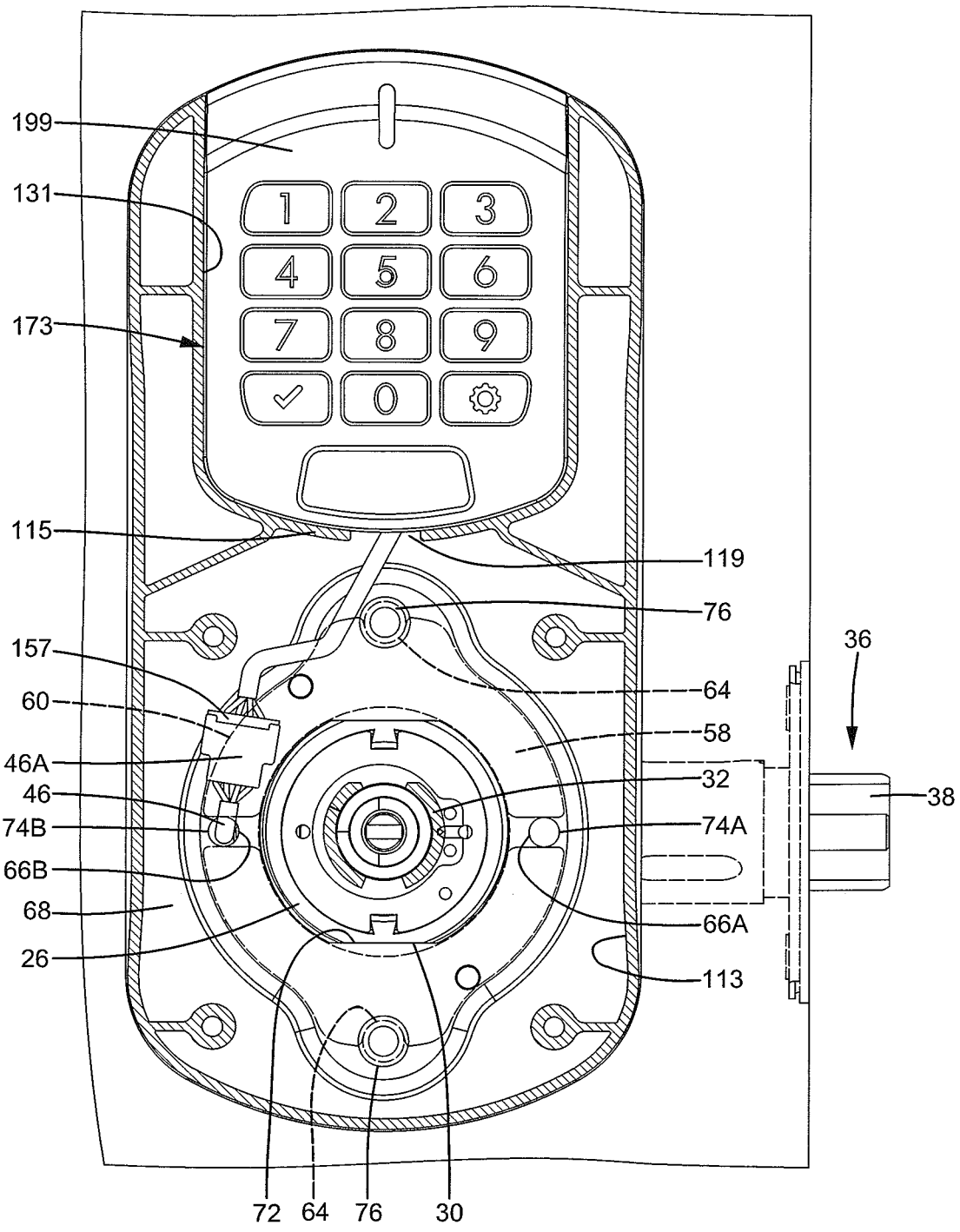
FIG. 10 is a view similar to FIG. 8, with the electric door lock installed on a right-handed door.

When it is desired to install the electric door lock 10 on a right-handed door, with reference to FIG. 10, the latch device 36 is located on the same side as the first groove 74A and the second groove 66A, such that the second cable 46 of the electrical connecting module 43 selectively extends through the outer fixing member 68 and the adjusting ring 58 via the first groove 74B and the second groove 66B, respectively. Likewise, the second electric connector 46A is located in the first compartment 113 of the outer casing 111 and is electrically connected to the fourth electric connector 191 of the outer electronic device 173.

Furthermore, the power supply 135 is detachably coupled to the inner casing 88. When it is desired to replace the plurality of batteries 153, a user can push and move the lid 137 to a position in which each of the hooks 139 of the lid 137 aligns with one of the separating openings 96 of the inner casing 88. Thus, the power supply 135 and the inner casing 88 can be separated, and the batteries 153 can be replaced.

The outer fixing member 68 includes two first grooves 74A and 74B, such that the electric door lock 10 permits adjustment of the second cable 46 of the electrical connecting module 43 according to the assembling direction or location of the door 48 to avoid the latch device 36. Furthermore, the second cable 46 selectively extends through the outer fixing member 68 via one of the two first grooves 74A and 74B to enter the first compartment 113 of the outer casing 111. Thus, the electric door lock 10 according to the present invention has an advantage of convenient assembly.

The two positioning grooves 64 of the adjusting ring 58 are coupled with the two fixing pegs 76 of the outer fixing member 68 to align the two second grooves 66A and 66B with the two first grooves 74A and 74B of the outer fixing member 68, such that the adjusting ring 58 is prevented from rotating relatively to the operating device 20. Thus, the second cable 46 of the electrical connecting module 43 can smoothly extend through the outer fixing member 68 via one of the first grooves 74A and 74B and extend through the adjusting ring 58 via one of the two second grooves 66A and 66B. Furthermore, the adjusting ring 58 will not pull or stretch the second cable 46, because the adjusting ring 58 fixed by the two fixing pegs 76 is not rotatable.

The elastic pad 193 of the outer electronic device 173 includes a lip 195 pressed by a pressing ring 211 of the cover 199, such that water or dust is prevented from entering elastic pad 193, thereby reducing the risk of malfunction of the circuit board 179.

Now that the basic teachings of the present invention have been explained, many extensions and variations will be obvious to one having ordinary skill in the art. For example, the outer electronic device 173 can be an electronic input device other than the keypad-type pin number entering device, such as a fingerprint input device, a voice input device, an iris input device or other input device capable of comparing information for unlocking purposes.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An electric door lock comprising:

an operating device configured to be set to a locking state or an unlocking state and adapted to be mounted to a door;

a latch device operably connected to the operating device, wherein the latch device includes a latch, and wherein the operating device is configured to move the latch between a latching position and an unlatching position;

an outer operating member operably connected to the operating device, wherein the outer operating member is configured to move the latch device from the latching position to the unlatching position;

an electric driver operably connected to the operating device, wherein the electric driver is configured to set the operating device to the locking state or the unlocking state;

an electrical connecting module connected to the electric driver, wherein the electrical connecting module includes a first cable and a second cable, and wherein the first cable and the second cable are outside of the operating device;

an inner fixing member including an inner mounting hole coupled with the operating device and an inner groove contiguous to the inner mounting hole, wherein the first cable extends through the inner fixing member via the inner groove, and wherein the inner fixing member is adapted to be fixed on an inner surface of the door;

an outer fixing member having an outer mounting hole coupled with the operating device and two first grooves contiguous to the outer mounting hole, wherein the second cable extends through the outer fixing member via one of the two first grooves in an assembling direction along which the latch device and the operating device are installed on the door, and wherein the outer fixing member is adapted to be fixed on an outer surface of the door;

an inner casing coupled to the inner fixing member, wherein the inner casing includes an inner room receiving the inner fixing member and an opening extending from an outer surface of the inner casing through an inner surface of the inner casing;

an outer casing coupled to the outer fixing member, wherein the outer casing includes an inner side and an outer side, wherein the outer casing further includes a first compartment formed at the inner side and receiving the outer fixing member and a second compartment formed at the outer side and spaced from the first compartment, and wherein the outer casing further includes a notch intercommunicating with the first compartment and the second compartment;

an inner electronic device received in the inner room of the inner casing, wherein the inner electronic device is electrically connected to the first cable, and wherein the inner electronic device is configured to control the electric driver to set the operating device to the locking state or the unlocking state;

an outer electronic device fixed in the second compartment, wherein the second cable is electrically connected to the outer electronic device through the notch, and wherein the outer electronic device is configured to send an unlocking signal to the inner electronic device; and a power supply coupled to the opening of the inner casing and electrically connected to the inner electronic device.

2. The electric door lock as claimed in claim 1, further comprising:

an adjusting ring threadedly engaged with the operating device and received in the first compartment of the outer casing, wherein the adjusting ring includes an outer periphery and two second grooves formed in the outer periphery, wherein the two second grooves are respectively aligned with the two first grooves of the outer fixing member, wherein the second cable extends through the adjusting ring via one of the two second grooves in the assembling direction.

3. The electric door lock as claimed in claim 2, further comprising:

two fixing pegs fixed on the outer fixing member and located outside of the outer mounting hole, wherein the adjusting ring includes two positioning grooves formed in the outer periphery, wherein each of the positioning grooves is located between the two second grooves in a circumferential direction about a longitudinal axis defined by the operating device, wherein the two fixing pegs are engaged with the two positioning grooves respectively, and wherein the two fixing pegs are configured to extend through the door; and two bolts extending through the inner fixing member, wherein the two bolts are threadedly engaged with the two fixing pegs respectively.

4. The electric door lock as claimed in claim 3, wherein the two positioning grooves are spaced from each other by 180° in the circumferential direction about a longitudinal axis defined by the operating device.

5. The electric door lock as claimed in claim 1, wherein the operating device includes a chamfered face formed on an outer surface of the operating device, wherein the outer fixing member includes an abutting face formed at the outer mounting hole, wherein the outer mounting hole of the outer fixing member is non-rotatably coupled with the operating device through the abutting face.

6. The electric door lock as claimed in claim 1, wherein the first cable includes a first electric connector electrically connected to an end thereof, wherein the second cable includes a second electric connector electrically connected to an end thereof, wherein the inner electronic device includes a third electric connector detachably and electrically connected to the first electric connector, wherein the outer electronic device includes a fourth electric connector detachably and electrically connected to the second electric connector, and wherein the notch is slightly larger than the fourth electric connector.

7. The electric door lock as claimed in claim 1, wherein the outer electronic device includes:

a box having a space;

a circuit board received in the space;

a cover mounted to a side of the box and covering the space, wherein the cover includes a pressing ring provided on an inner side of the cover, with the pressing ring having annular cross sections; and an elastic pad mounted between the cover and the circuit board, wherein the elastic pad includes a lip aligned with the pressing ring of the cover, and wherein the pressing ring of the cover presses against the lip of the elastic pad.

8. The electric door lock as claimed in claim 7, wherein the outer electronic device further includes:

a plurality of buttons mounted between the cover and the circuit board, wherein the elastic pad further includes a plurality of pressing portions, wherein each of the plurality of pressing portions supports a respective one of the plurality of the buttons, and wherein each of plurality of the buttons is biased to protrude outside of the cover.

9. The electric door lock as claimed in claim 7, wherein the first cable includes a first electric connector electrically connected to an end thereof, wherein the second cable includes a second electric connector electrically connected to an end thereof, wherein the inner electronic device includes a third electric connector detachably and electrically connected to the first electric connector, wherein the outer electronic device further includes:

a fourth electric connector connected to the circuit board, wherein the fourth electric connector is detachably and electrically connected to the second electric connector.

* * * * *